United States Patent [19]

Marcussen

[11] 4,118,957

[45] Oct. 10, 1978

[54] CENTRIFUGAL DISPENSER FOR WASHING MACHINE AGITATOR

[75] Inventor: Henry Marcussen, Fremont, Ohio

[73] Assignee: Whirlpool Corporation, Benton Harbor, Mich.

[21] Appl. No.: 774,702

[22] Filed: Mar. 4, 1977

[51] Int. Cl.[2] ..... D06F 39/02

[52] U.S. Cl. ..... 68/17 A

[58] Field of Search ..... 68/17 A; 222/52

[56] References Cited

U.S. PATENT DOCUMENTS 3,370,444 2/1968 Wolters ..... 68/17 A X

*Primary Examiner*—Philip R. Coe

*Attorney, Agent, or Firm*—Hill, Gross, Simpson, Van Santen, Steadman, Chiara & Simpson

[57] ABSTRACT

A compact and shallow rinse agent dispenser is removably assembled upon the top of an agitator in an automatic clothes washing machine for dispensing a liquid product upon completion of a spin cycle of the washing machine. An annular, wave dampening baffle is fixed inwardly adjacent the rim of a receptacle cup in which the liquid product is initially placed. The baffle is vertically slotted and limits splashing of the liquid into a dispensing chamber or through filling ports in the cover of the dispenser during the agitation cycle, prior to spin. The discharge chamber to which liquid is passed during the spin cycle has a number of impeller vanes fitted adjacent radially-inwardly-disposed discharge openings therein to minimize loss of liquid during start-up stages of the spin cycle, when centrifugal forces alone are insufficient to confine the liquid to the outside of the chamber.

4 Claims, 7 Drawing Figures

Fig. 3
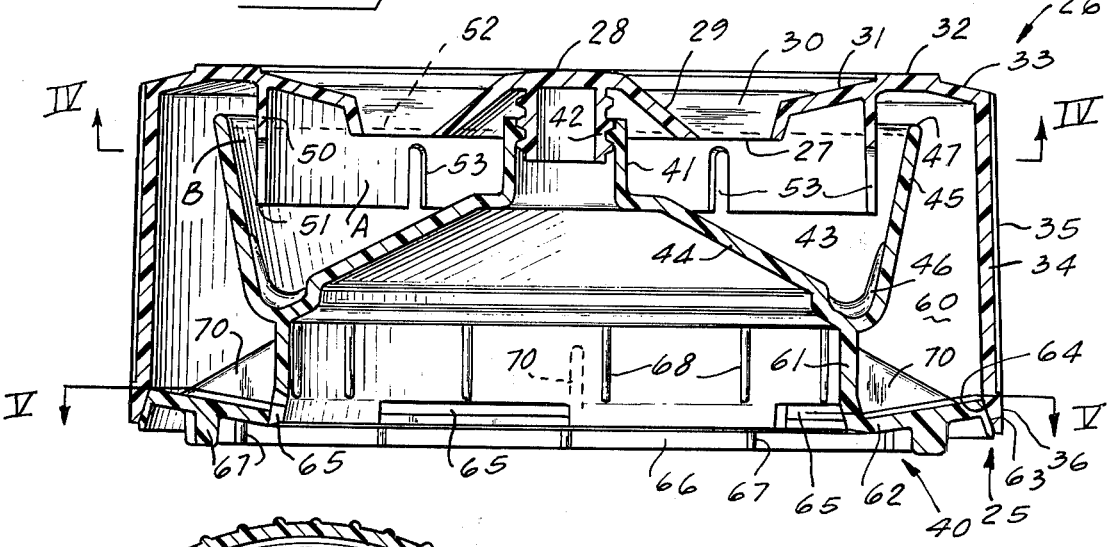
Fig. 4
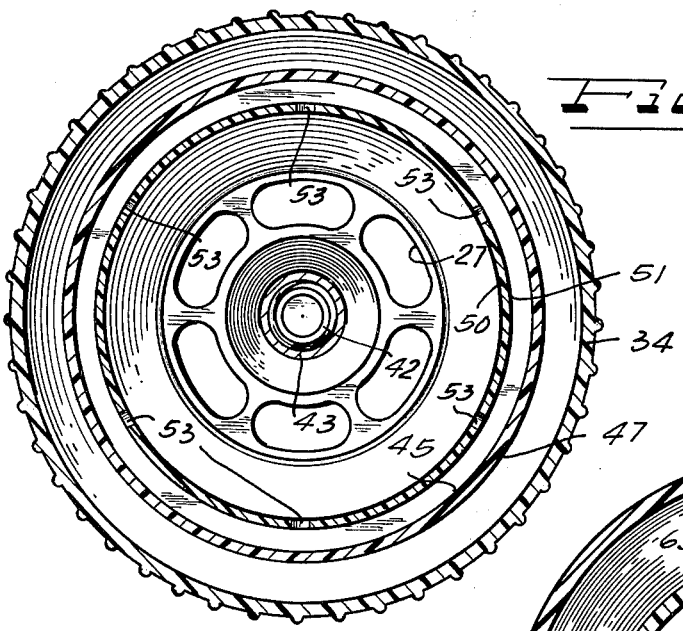
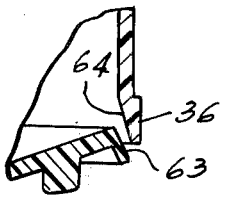
Fig. 7
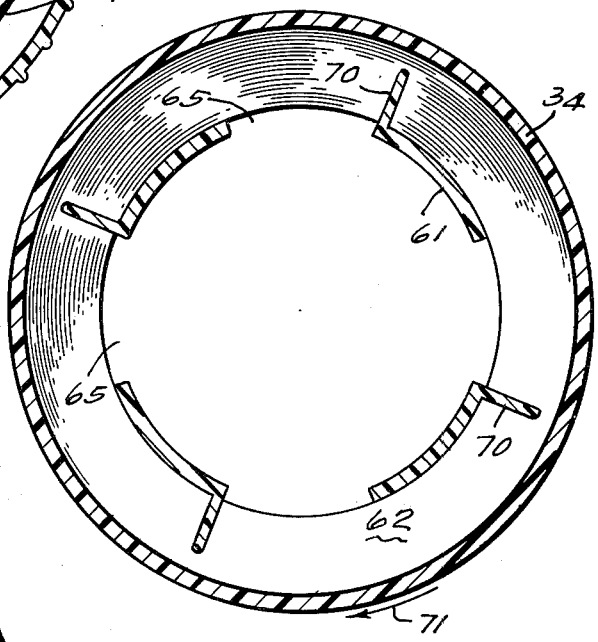
Fig. 5
Fig. 6
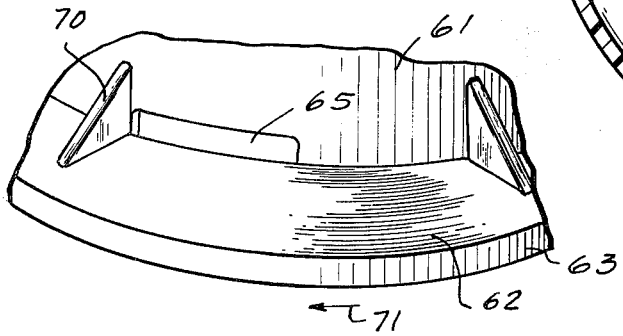

CENTRIFUGAL DISPENSER FOR WASHING MACHINE AGITATOR

BACKGROUND OF THE INVENTION

1. Field of the Invention

The present invention relates generally to centrifugal liquid dispensers for use with agitators of automatic washing machines and similar devices.

2. The Prior Art

Vertical axis automatic washing machines such as those exemplified by U.S. Pat. Nos. 3,620,054 issued Nov. 16, 1971 and 3,370,444 issued Feb. 27, 1968, have a basket for receiving articles to be laundered and an agitator element mounted within the basket coaxially therewith. The agitator is oscillated during an agitation cycle, and then the agitator and basket are spun to extract washing liquid from the clothing. One or more rinse cycles follow, each comprising an agitation cycle followed by a spin cycle for removing the rinse liquid.

Additives are automatically supplied to the washing and rinsing zone during the washing sequence, especially a fabric softening agent at the beginning of the first rinsing cycle. A centrifugally actuated dispenser combined into an agitator cup is frequently employed. Such dispensers provide a pair of concentrically disposed, annular chambers or receptacles separated by a sloping wall. The liquid to be dispensed is placed within the inner chamber, where it remains until the agitator is rapidly rotated during the spin cycle. Centrifugal force imposed by the rapid rotation causes the liquid to pass over the sloping wall and into the outer chamber, from which it will flow through radially-inwardly-disposed apertures when rotation ceases.

In a new form of automatic washer agitator such as disclosed in U.S. Pat. No. 3,987,651, Platt, assigned to the assignee of the present invention, a two-part agitator promotes an improved rollover action. For example, a slip clutch causes an upper auger part to rotate unidirectionally in the presence of heavy loads of laundry and vanes on this upper auger part help to ensure toroidal movement of the laundry in the washing and rinsing zone. Such a two-part agitator means includes the upper auger part which may extend somewhat above the level of wash liquid in the tub or basket and a lower part which oscillates and includes agitator vanes which may be either flexible or rigid.

Liquid dispensers heretofore provided in the prior art are not entirely suitable for use with such two-part agitators. U.S. Pat. No. 3,620,054 for example discloses a relatively deep dispenser having an inner cup portion with steeply sloping walls which could not be arranged about the upper portion of a two-part agitator without interference with the blades on the upper part of the agitator and the washer lid. U.S. Pat. No. 3,370,444 discloses a dispensing apparatus in a vertically reciprocable washing machine agitator wherein liquid in the dispenser is maintained in a turbulent or frothing state in the center of the storage chamber of the dispenser while the agitator reciprocates.

SUMMARY OF THE INVENTION

An agitator-mounted liquid dispenser particularly suited for vertical-axis washing machines utilizing a two-part agitator means comprises a first chamber formed by a cup and a cover to provide a shallow compact assembly. An apertured, circumferentially continuous wave dampening ring or baffle extends downwardly from the cover, spaced radially inwardly adjacent the cup wall, to limit movement of the liquid during the agitator cycle by compartmentalizing effectively the space into separate annular areas so that the fluid contained therein is likewise compartmentalized into separate annular parts. Thus, the liquid is calmed and the ring or baffle prevents splashing during agitation.

A second chamber arranged below and radially outwardly of the cup and beneath the cover accepts and holds liquid driven centrifugally over the sloping wall of the cup during the spin cycle and has a plurality of drain apertures in a radially inward portion thereof for passing the liquid to a washing zone of the machine at the end of the spin cycle. A plurality of impeller vanes are arranged in a lower and radially-inward portion of the second chamber circumferentially adjacent the drain apertures to direct the liquid during early stages of the spin cycle away from the drain apertures.

THE DRAWINGS

FIG. 3 is a cross-sectional view through the dispenser, taken on line III—III of FIG. 2.

FIG. 4 is a bottom plan view in section of the upper portion of the fabric dispenser, taken on line IV—IV of FIG. 3.

FIG. 5 is a sectional view of the liquid dispenser, taken generally on line V—V of FIG. 3.

FIG. 6 is a perspective view of a portion of the lower, inner portion of the discharge chamber.

FIG. 7 is a sectional view of a portion of the dispenser showing corresponding surfaces of different parts of the dispenser in an untightened condition.

THE PREFERRED EMBODIMENTS

Figure 1:
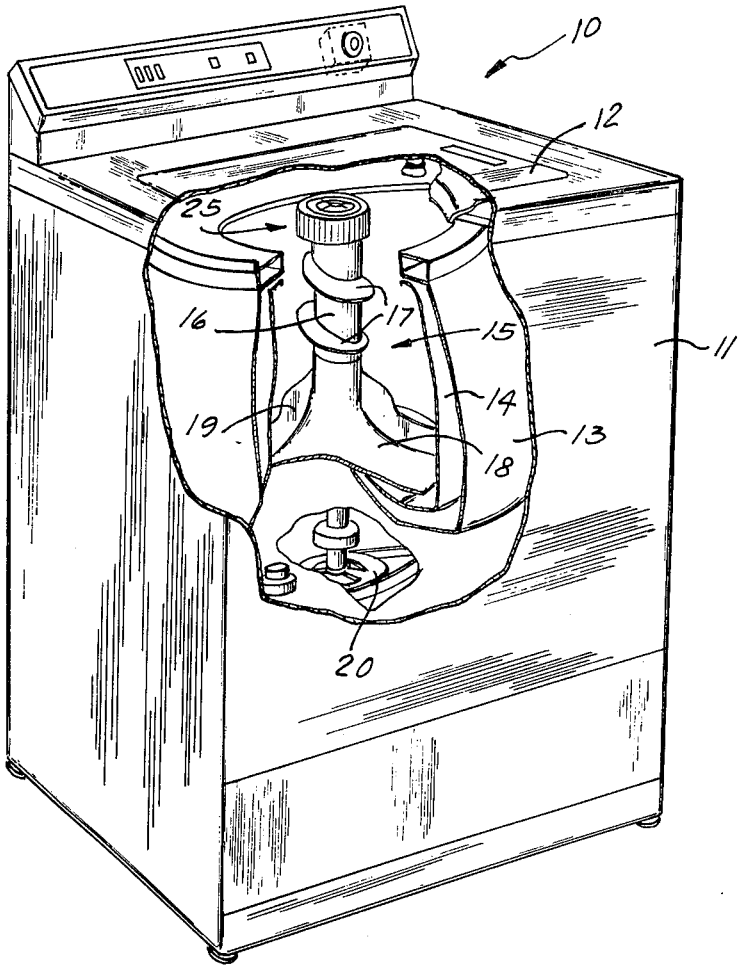
FIG. 1 is a perspective view of a washing machine employing the present invention, with parts broken away to show additional details.

FIG. 1 shows a general view of a washing machine 10 having a cabinet structure 11 with a top-opening door 12 enclosing a washing tub 13 and perforate basket 14. Coaxial with the tub 13 and basket 14 is a two-part agitator assembly, herein exemplified by a vertical-axis agitator assembly 15. A unidirectionally rotatable upper part comprises an auger portion 16 having a helical vane 17. A lower skirt portion 18 of agitator assembly 15 is disposed in the lower part of the basket 14 and has a plurality of radial vanes 19 affixed thereto which may be of the flexible vane type, if desired. The agitator assembly 15 is driven by drive means 20 through an agitation cycle wherein the skirt portion 18 oscillates in to-and-fro motions in the bottom of the basket 14 while the auger portion 16 rotates unidirectionally and tends to force wash liquid and clothing within the basket 14 and the tub 13 downwardly along agitator portion 16 toward the vanes 19, which tend to move the articles being laundered outwardly and upwardly. Such combined action of the two portions of the agitator 15 assures an improved positive rollover of even heavy loads of clothing and uniformly good wash results throughout all portions of the load. Other forms of agitators known and commonly used in the art do not have a separate upper portion 16 characterized by an outwardly projecting helical vane but rather have a one-piece agitator which is relatively narrow at the top and hence more compatible with centrifugal dispensers combined into an agitator mounted cup.

To dispense a fabric softening or other rinsing agent for mixing with rinse water following the spin cycle, a centrifugal rinse dispenser 25 in accordance with this invention is fitted to the top of the agitator 15 beneath the openable lid 12 of the machine cabinet 11. In accordance with the principles of the present invention, the liquid agent dispenser 25 is compact and unusually shallow and entirely compatible with a two-part agitator means.

Figure 2:
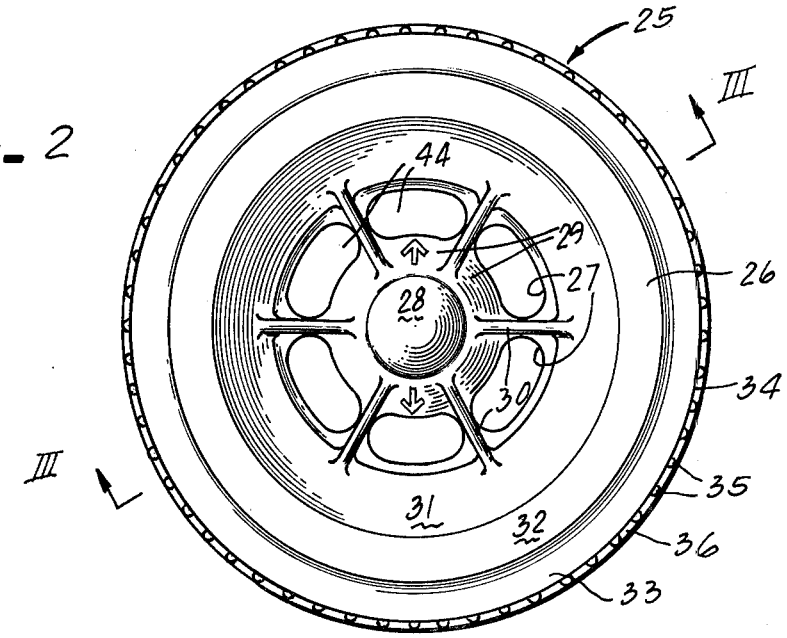
FIG. 2 is a top plan view of the centrifugal rinse dispenser of the present invention.

FIG. 2 shows a top view of the liquid agent dispenser 25, having a dispenser cover portion 26. Filling ports 27 are arranged concentrically about a center portion 28 of the cover 26, it being intended that the user of the machine 10 may pour liquid rinsing agent directly on the center portion 28 in a measured amount and the liquid will then flow over surrounding downwardly sloping surfaces 29 and into the filling ports 27. Radially-extending ribs 30 connect the portion 28 and the surfaces 29 to the outer portion of the cover 26; these ribs 30 are narrow in the circumferential direction and so will not support any appreciable flow of rinsing agent along upper surfaces thereof. The outer portion of the cover 26 has a downwardly and inwardly sloping surface 31 and outer rings 32 and 33 to provide the necessary volume in the dispenser 25 for the functioning thereof. Any of the surfaces 31–33 may carry use instructions, identifying information, and other data thereon. An outer, vertical wall 34 of the dispenser 25 is conveniently formed with a plurality of vertical ridges 35 and a short lower skirt portion 36.

FIG. 3 shows details of the internal construction of the liquid agent dispenser 25, including a body portion or inner member 40. The inner member 40 connects to the cover member 26 at the upper center thereof by a threaded sleeve 41 connecting to a threaded stud 42 arranged on an undersurface of the central portion 28. Outwardly of the sleeve 41 a cup or reservoir portion 43 is formed by a downwardly sloping wall 44 and an upwardly sloping wall 45. Small brace members 46 are provided at the base of the cup 43 to rigidify the outer wall 45. The wall 44 slopes downwardly in a radially outward direction to provide necessary clearance for a top cover of the auger portion 16 of the agitator 15. The liquid rinse agent is concentrated in the outer portion of the cup 43. The outer wall 45 slopes upwardly in an outward direction so that centrifugal force acting on liquid within the cup 43 will direct the liquid over an annular lip 47 at the upper circumference of the wall 45.

In accordance with the principles of the present invention, the cover member 26 is formed with a wave dampening means or anti-splash means which takes the form of a downwardly depending annular flange or baffle 50 having a diameter and depth to be received in spaced, inward adjacency from the outer wall 45 of the cup portion 43, thereby to substantially compartmentalize the liquid chamber within the interior of the cup 43 and the body of liquid therein into separated annular zones A (inwardly of the baffle 50) and B (outwardly of the baffle 50). A lower outer edge 51 of the baffle 50 is located well beneath a normal liquid fill line 52 within the liquid dispenser 25. Because the edge 51 is in close proximity to the wall 45, the baffle 50 has a dynamic effect in reducing turbulence or splashing of liquid within the cup 43 and over the lip 47 of the outer wall 45. The liquid will be circulated circumferentially about the cup 43 to only a small degree upon intermittent unidirectional rotations of the auger portion 16, since the smooth inside surface of the cup 43 will accelerate the liquid in the cup slowly.

Formed through the lower portion of the baffle 50 is a plurality of apertures 53 in the form of vertical slots through the baffle 50. The spacing of the apertures 53 in the baffle 50 may correspond radially to each of the filling ports 27, as depicted in plan view in FIG. 4. These apertures 53 allow liquid agent, which under some conditions will flow or splash upwardly through the filling ports 27 and onto the top of the cover 26, to flow into any vacant space in zone B, between the baffle 50 and the outer wall 45 of the cup 43.

A discharge chamber 60 is provided radially outwardly of and below the cup 43, as shown in FIG. 3. The chamber 60 is bounded about its outer periphery by the wall 34 of the cover 26. On its inner periphery is the wall 45 of the cup 43 and a vertical wall 61 connected to a lower part of the cup 43. The lower boundary of the discharge chamber 60 is a lower annular surface 62 which slopes upwardly in the outward direction to engagement with the cover wall 34. Annular mating surfaces 63 and 64 are provided respectively on the lower surface 62 and the wall 34 at their junction, the surfaces 63, 64 being forced into engagement with one another by the threaded connection between the sleeve 41 on the inner part 40 and the stud portion 42 on the cover 26. The conical shape of the surfaces 63, 64 together with the characteristic that the two surfaces are non-parallel in cross section in the untightened condition (see FIG. 7) improves the fluid-tightness of the joint therebetween since the surfaces will be forced tightly together as the two dispenser parts 40 and 26 are screwed tightly together. The inner wall 61 is bonded to the inside portion of the lower wall 62 except at dispensing drain apertures 65 formed therebetween at spaces around the circumference of the joint. The upper part of the discharge chamber 60 is bounded by the cover 26 and the baffle 50. An annular reinforcing rib 66 about the underside of the lower wall 62 has radially-extending tabs 67 to supplement the strength of the wall. The radially inward surface of the inner wall 61 has engagement ribs 68 projecting inwardly therefrom to removably press-fittingly engage the upper portion of the auger agitator part 16 for mounting of the dispenser 25 on the agitator.

Further in accordance with the principles of the invention, a plurality of impeller vanes 70 are provided in the radially inward, lower portion of the discharge chamber 60, affixed to the inner wall 61 and the lower annular wall 62. Each of the impeller vanes 70 in the embodiment shown is triangular in side view (see FIG. 6) and extends radially and vertically of the axis of the agitator 15. Each of the vanes 70 further is arranged at the forward or leading end of a respective one of the discharge apertures 65, as shown in FIGS. 5 and 6, with respect to the arrows 71 which designate the direction of rotation of the dispenser 25 during the spin extraction cycle. The vanes 70 divert liquid agent passing from the cup 43 over the lip 47 and into the discharge chamber 60 during early stages of a spin cycle from passing out the discharge apertures 65 prematurely and being extracted from the tub 13 with the dirty wash liquid. These small quantities of liquid entering into the chamber 60 will be accelerated circumferentially by the impeller vanes 70 and collected forwardly thereof until centrifugal forces overcome the gravitational urging of the liquid to flow down and out the apertures 65.

The impeller vanes 70 are particularly useful where a large or off-balance laundry load is present within the basket 14, so that the driving mechanism 20 can accelerate the basket, agitator, and contents only relatively slowly. As soon as the basket 14 and agitator 15 stop spinning at the end of the spin cycle, the vanes 70 will have no effect in preventing the rinsing agent from escaping through the discharge apertures 65 into the basket 14 and tub 13 to be mixed with rinsing water.

In use and operation, the liquid agent dispenser 25 is placed with the inner member 40 engaged over the top of the upper or auger portion 16 of the two-part agitator 15, with the cover portion 26 fitted thereover by the threaded connection 41, 42. Prior to setting the washing machine 10 into operation, the user of the machine will add liquid agent to the cup 43 of the dispenser 25, as by pouring it onto the surface of center portion 28. Most commonly, a concentrated agent will be employed, which is to be measured into the dispenser 25 and then diluted with water to fill the dispenser. The lid 12 of the machine 10 is then closed and the agitation cycle started. Rinsing agent within the cup 43 will tend to oscillate with or be rotated unidirectionally with the auger 16. Any waves and splashes created will urge the contents of the cup 43 outwardly and up the wall 45. These shifts in the liquid are disrupted and controlled by the wave dampening means or anti-splashing means provided by the baffle 50. The apertures 53 through the baffle 50 permit flow-through without disturbing a relatively calm and stable condition of the body of fluid which is divided into two annular parts.

At the conclusion of the agitation cycle, free liquid within the basket 14 will be pumped from the tub 13 as the basket 14 and agitator assembly 15 with the liquid dispenser 25 thereon are spun in a single direction in a spin extraction cycle. As the dispenser 25 spins and eventually exceeds a certain rate of rotation, liquid in the cup 43 is forced outwardly against the sloping wall 45 and will flow upwardly over the lip 47 thereof. It will then pass into the chamber 60, where it will be prevented from passing out the apertures 65 by the impeller vanes 70 at low speeds of rotation and by centrifugal force at higher rates of speed and during the bulk of the spinning cycle. Upon conclusion of the spin cycle, liquid within the discharge chamber 60 will gradually pass into and through the discharge apertures 65 under the influence of gravity. From the apertures 65 the liquid will pass down the sides of the auger part 16 into the basket 14, where it will be mixed with incoming rinse water.

From time to time the cover 26 may be removed from the inner member 40 for cleaning of the dispenser 25. In this regard the easy removability of the lower member 40 from the agitator portion 16 is helpful, since the entire dispenser 25 may be taken to a sink or other location for cleaning.

Where a two-part auger agitator is employed in an automatic washer the one-way clutch means drivingly connecting the upper auger part of the agitator to the oscillating lower agitator part may be designed so that it will slip only when relatively large wash loads are present in the basket which will press against the agitator and generate resistance to auger movement in the slipping direction. If the two-part agitator is so designed, the auger part of the agitator will oscillate with the lower agitator part when a small load is present during the wash cycle and will rotate unidirectionally in response to the oscillations of the lower agitator part when large loads are present. Regardless of whether the dispenser mounted on the auger part of the agitator is oscillating or rotating unidirectionally, the slotted annular baffle according to the present invention will provide a calming effect on the liquid in the dispenser cup and thereby minimize the escape of liquid from the cup during the agitate portion of the machine cycle.

Although the dispenser incorporating the baffle according to the present invention is especially advantageous when used in combination with a two-part agitator including an auger part which rotates intermittently and unidirectionally, it is also highly useful in combination with more conventional agitators. The dispenser, including a baffle as herein disclosed, may be made compact in both height and diameter while still providing approximately the same useful dispensing volume as substantially larger centrifugal dispensers known previously in the art.

Although various minor modifications may be suggested by those versed in the art, it should be understood that I wish to embody within the scope of the patent warranted hereon all such modifications as reasonably and properly come within the scope of my contribution to the art.

The embodiments of the invention in which an exclusive property or privilege is claimed are defined as follows:

1. An agitator-mounted dispenser for liquid agent for a non-reciprocating vertical-axis washing machine, the dispenser comprising:

a cup means for containing the liquid agent prior to a spin cycle of said machine and having, an upwardly-sloping peripheral wall means, and an apertured annular baffle means spaced radially inwardly adjacent said wall means to limit splashing of said liquid agent during an agitation cycle;

a discharge chamber means for accepting and holding liquid agent driven centrifugally over said wall means of said cup means during said spin cycle and having a plurality of drain apertures in a radially inward portion thereof for passing said liquid agent gravitationally to a washing zone of said machine at the end of said spin cycle, and said discharge chamber means further comprising impeller vanes in a lower and radially-inward portion thereof and adjacent said drain apertures for directing said liquid agent during an early stage of said spin cycle away from said drain apertures.

2. An agitator-mounted dispenser for liquid agent as defined in claim 1, wherein each of said impeller vane means extends vertically and radially from a forward end of one of said drain apertures.

3. In a washing machine of the vertical axis type, a centrifugal dispensing apparatus mountable atop an agitator thereof for releasing a liquid therein into a clothes-holding basket of the machine after a spin-extraction cycle thereof, the dispensing apparatus comprising:

an upwardly-open cup affixed atop said agitator substantially coaxially therewith and having an upwardly-sloping side wall ending in a peripheral lip;

a cover portion overlying said cup and spaced above said peripheral lip;

an annular baffle extending from said cover portion into said cup to a depth below said lip thereof and spaced radially inwardly adjacent said lip and said side wall;

a plurality of apertures formed through said baffle;

a dispensing chamber formed about and below said cup by an annular, generally vertical outer wall, a lower annular wall, an inner, generally vertical, annular wall joined to said cup, and having a plurality of dispensing apertures through at least one of said lower annular wall and said inner wall, and a plurality of generally radially-extending impeller vanes affixed to said lower annular wall and said inner wall in said dispensing chamber adjacent said dispensing apertures, thereby to improve liquid dispensing reliability.

4. A compact dispenser mountable on a rotatable agitator of a clothes washing machine for discharging liquid into a wash tub after a spin-extraction operation of said tub and agitator, the dispenser comprising a first member received over an upper end of said agitator and having an inner annular wall and an upwardly sloping lower annular wall bounding a dispensing chamber formed outwardly of said agitator and having drain apertures formed in and spaced about one of said inner wall and said lower annular wall and a plurality of vertically and radially-extending impeller vanes affixed to the lower annular surface of the first member in said dispensing chamber, each of said vanes contacting said inner wall adjacent one of said drain apertures, and said first member further having a shallow cup portion received above said agitator and radially inwardly of said dispensing chamber and having a peripheral wall sloping upwardly and outwardly thereabout to an annular lip; and a second member having a vertical, annular outer wall bounding the dispenser chamber and engaging an outer periphery of the lower annular wall of the first member in substantially liquid-tight relation thereto and a top cover portion bounding the cup portion and having filling apertures therein, the first and second members having connection means therebetween for attaching the second member in a position overlying the first member; and the dispenser particularly comprising:

an annular baffle extending downwardly from said cover portion of said second member and into said cup portion to a rim located beneath the level of and spaced radially inwardly of the annular lip and wall of said cup portion of said first member; and a plurality of circumferentially spaced-apart apertures formed through said baffle.

* * * * *